US005347449A

United States Patent [19]

Meyer et al.

[11] Patent Number: 5,347,449

[45] Date of Patent: Sep. 13, 1994

[54] METHOD FOR ELIMINATING MALFUNCTIONS, IN PARTICULAR IN SPINNING MACHINES

[75] Inventors: Urs Meyer, Niederglatt; Roland Beringer, Hausen b. Brugg, both of Switzerland

[73] Assignee: Maschinenfabrik Rieter AG, Winterthur, Switzerland

[21] Appl. No.: 778,813

[22] PCT Filed: Apr. 23, 1991

[86] PCT No.: PCT/CH91/00097

§ 371 Date: Dec. 18, 1991

§ 102(e) Date: Dec. 18, 1991

[87] PCT Pub. No.: WO91/16481

PCT Pub. Date: Oct. 31, 1991

[30] Foreign Application Priority Data

| | | | |
|---|---|---|---|
| Apr. 24, 1990 | [DE] | Fed. Rep. of Germany | 4012930 |
| Jan. 23, 1991 | [CH] | Switzerland | 0189/91-5 |
| Apr. 5, 1991 | [CH] | Switzerland | 1025/91-2 |

[51] Int. Cl.[5] ..... G05B 9/02; G06F 15/46; D01H 13/14

[52] U.S. Cl. ..... 364/185; 364/470; 57/264; 57/265

[58] Field of Search ..... 364/185, 188, 189, 470, 364/550, 551.01; 57/264, 265, 81; 340/525, 506

[56] References Cited

U.S. PATENT DOCUMENTS

| | | | |
|---|---|---|---|
| 4,005,392 | 1/1977 | Akatsuka et al. | 364/152 |
| 4,167,041 | 9/1979 | Curlander et al. | 395/575 |
| 4,294,065 | 10/1981 | Lane | 57/81 |
| 4,408,447 | 10/1983 | Sloupensky et al. | 57/263 |
| 4,534,042 | 8/1985 | Marsícek et al. | 364/470 |
| 4,563,873 | 1/1986 | Tooka | 57/264 |
| 4,656,465 | 4/1987 | Erni et al. | 340/679 |
| 4,823,544 | 4/1989 | Igel | 57/265 |
| 4,835,699 | 5/1989 | Mallard | 364/470 |
| 4,965,567 | 10/1990 | Meyer | 57/81 |
| 5,224,047 | 6/1993 | Kitagawa et al. | 364/470 |

FOREIGN PATENT DOCUMENTS

| | | |
|---|---|---|
| 0026111 | 4/1981 | European Pat. Off. . |
| 1907990 | 11/1969 | Fed. Rep. of Germany . |
| 1800434 | 5/1970 | Fed. Rep. of Germany . |
| 3135333 | 3/1983 | Fed. Rep. of Germany . |
| 3701796 | 8/1988 | Fed. Rep. of Germany . |
| 3841464 | 6/1990 | Fed. Rep. of Germany . |
| 2098414 | 3/1972 | France . |
| 661913 | 8/1987 | Switzerland . |

OTHER PUBLICATIONS

Melliand Textilberichte Apr. 1973 (Article) pp. 331–334.

Melliand Textilberichte Apr. 1988 (Article) pp. 548–553.

*Primary Examiner*—Paul Gordon

*Attorney, Agent, or Firm*—Dority & Manning

[57] ABSTRACT

A method and system is provided for eliminating malfunctions in textile machines, in particular spinning machines. Malfunction signals are transmitted from the machine to a process control computer that controls the elimination of the malfunctions. The process control computer activates an alarm call transmitter that calls a desired specialist for removing the malfunction in a certain machine.

23 Claims, 7 Drawing Sheets

NETWORK BETWEEN MACHINES, OPERATING ROBOTS AND CONVEYING SYSTEMS

METHOD FOR ELIMINATING MALFUNCTIONS, IN PARTICULAR IN SPINNING MACHINES

BACKGROUND OF THE INVENTION

The invention relates to a method for eliminating malfunctions in machines, in particular in spinning machines, whereby fault signals are transmitted from the machine to the process control computer controlling the elimination of the malfunction.

In fully automatic yarn production plants, for example, there is only a minimum of service personnel present. They must be able to deal with the malfunctions directly, without delay and in accordance with the operational priorities in order to maintain the usefulness of the whole plant. Present alarm systems do not set the priorities of the required actions in accordance with operational necessities, resulting in delays and unnecessary stress to the personnel.

Alarm systems are known that comprise, for example, blinkers or pertinent acoustic signals in a spinning room or in an individual machine. These alarms are, however, unspecific and unnecessarily stress the operating personnel and in addition give no indication as to the type, place, and priority of the malfunction.

Optical alarm systems must be visible from all sides, whereas acoustic signals are difficult to hear due to the background noise caused by the machines.

Monitor supervising systems for whole groups of machines are known. These systems, however, requires a person who continuously monitors the screen or who, in the event of am alarm, first has to proceed to said screen.

From the DE-OS 31 35 333 a method is known for controlling the operator's or a mobile maintenance device's tasks in a spinning plant comprising a number of operating stations. According to this system, any cases requiring operator intervention are recorded with type and date, and are transmitted to a central data base. This central data base is then queried for cases requiring operator intervention. They are based on the priority of such operator intervention (disposition of causing damage), whereby at least the place and, optionally, the type of the action required according to the event of the highest priority is submitted to the operator or the mobile maintenance unit as the operating station to be serviced. This method has the disadvantage that any occurring malfunction is only recognized through the query itself.

OBJECTS AND SUMMARY OF THE INVENTION

It is a principal object of the present invention to provide a method of the type mentioned above with which recurring malfunctions are to be eliminated as quickly as possible according to their priority.

Additional objects and advantages of the invention will be set forth in part in the description which follows, and in part will be obvious from the description, or may be learned by practice of the invention.

The solution to this problem consists in a system with a transmitter for emitting an alarm controlled by the process control computer that calls the desired specialist to a certain machine for eliminating the malfunction.

Classical maintenance planning of maintenance specialists distinguishes between planned maintenance, such as lubricating, cleaning, regular checking, preventive replacement or overhauling of components, and the elimination of inadvertent malfunctions. In general, the maintenance work is carried out by unskilled personnel trained on the respective machine. The organization is equivalent to a normal, productive work session. The supervision and control is performed by a qualified specialist, who also trains the personnel.

However, the diagnosis and the elimination of malfunctions requires specialists trained in this field of work. They must be permanently available and able to work according to priorities when malfunctions occur simultaneously. The use of such specialists requires, first of all, a high amount of availability, that can only be realized at the expense of the specialist's performance.

The present method as provided by the invention optimizes the use of such specialists. A principal job ("occupancy work") consists of high-quality maintenance work not subject to any kind of work schedule or of supervising the maintenance team. In addition, there are special tasks that occur on an irregular basis, such as diagnosing and eliminating malfunctions. The decisive point is that the specialist must be able to fully concentrate on the respective task. Particularly when said specialist carries out his principal work, it can be quite disturbing for him if his attention is diverted by continuously supervising his background. This is the case, for example, in alarm systems that work with optical or acoustic signals.

Furthermore, it can be stressing for the specialist if he has to grasp, assess and determine the priority of his work in the event of several simultaneous malfunctions.

Finally, the on-site investigation of the malfunction, which is usually necessary in the event of a general alarm, causes a considerable loss in time. The tools required for eliminating a malfunction in present machines can no longer be carried on a belt. They usually have to be selected according to the task and malfunction and then brought to the site of the malfunction.

The situation gets even more complicated in the event of several malfunctions involving several specialists. In this case it is advisable to have a special manager coordinate the specialists' work schedule. This method, however, is very expensive, so that it is advisable to resort to a process control computer. Therefore, the process control computer takes over an active function, thus ensuring that a malfunction is recognized long before the information is extracted.

Preferably, the malfunction is to be classified in the machine itself, in particular in the machine controls. This means that the malfunction is allocated to a certain specialist, i.e. a foreman or a maintenance specialist, and provided with a certain priority. This information is then supplied from the machine to the process control computer that supervises a plurality of machines and collects the respective signals. The process control computer then sorts the signals according to machine and priority, and calls upon the desired specialist via the alarm transmitter.

The process control computer is also given the task of storing the status and the tasks performed on each machine in a log file, so that any malfunction that has occurred is recorded consistently and reliably without encumbering the staff with administrative work.

In addition, the alarm call of the alarm transmitter should include the place and the type of malfunction to enable the specialist to refer to the correct machine and take with him the tools required for eliminating a certain malfunction. The maintenance specialist can then read in the display means on the machine the place where the malfunction has occurred.

A principal idea behind the invention is to create an alarm system that collects reports on malfunctions in a plurality of machines and conveying systems, evaluates these in accordance with process-dependent priorities, alarms the competent personnel and informs them of the place and type of malfunction. In addition, the elimination of the malfunction is also supervised, because the specialist only issues the respective message when the malfunction has been eliminated. Furthermore, an error protocol is kept for the whole plant and for each machine.

In this way the correct specialist is automatically guided by the plant's process control computer to the right place with the right tools. Thereupon the suitable treatment of various kinds of malfunctions is carried out, even if there is an overlap of said malfunctions, due to the integration of priority evaluation in the process controls. Furthermore, a log file is reliably kept on all malfunctions, leading to a basis for future improvements.

Only the required personnel are alarmed for each task, and not other employees who might inadvertently be in the vicinity or are performing other tasks in the area of the machine. The normal maintenance works are carried out independent of the alarm, so that the maintenance personnel are fully available for unexpected tasks. In addition, the priorities of said tasks are continuously adapted to the needs of the current production. If necessary, the task with a lower priority is interrupted in order to carry out the repair of a more important malfunction.

The respective alarm system for carrying out the method in accordance with the invention consists of various components. Firstly, the process control computer needs to be mentioned. In the event of a malfunction, this computer receives the respective signals from the individual machine. As a rule, the signals are emitted by the machine control unit, whereby the signal preferably contains information on the urgency for eliminating the malfunction, the type thereof, and the personnel to be called in (operator, technician, foreman).

The central evaluation of the malfunction signals takes place in the process control computer that evaluates the individual malfunctions, inserts them into the priority queue, and stores the status of the individual machines in a kind of log file. This function is preferably taken over by an already existing process control computer that is also used for other functions.

The process control computer is also responsible for centrally supervising the individual specialists, whereby the computer also continuously knows the availability of the individual person, knows and also takes into account the tasks he can perform, and stores the tasks performed by means of a log file. This function, too, is taken over by an already existing process control computer that is also used for other functions.

In accordance with the invention, the process control computer is provided with an alarm transmitter that comprises a selective call for individual receivers. This alarm transmitter is connected via a radio link with the receivers carried by the specialists. This personal call receiver preferably comprises an alphanumerical display for short texts, so that the specialist can be informed about the place and the type of the malfunction. In this way the specialist is able to bring the required tools along with him.

On each machine there is a display means that, upon request, provides the specialist with the complete data on place, type and urgency of his next task.

A communications network connects the machine with the process control computer and, in addition, both the machine and the process control computer are provided with the respective programs.

This combination of components in the alarm system in accordance with the invention more or less makes use of devices that are required for controlling the production process in any case. Therefore, it is considerably less expensive than comparable systems. The only additional parts required are the alarm call devices and the programs for the additional functions of the process control computer and, optionally, the machine.

Further advantages, features and details of the invention arise from the following description of preferred embodiments and the drawing.

DETAILED DESCRIPTION OF THE PREFERRED EMBODIMENTS

Figure 1:
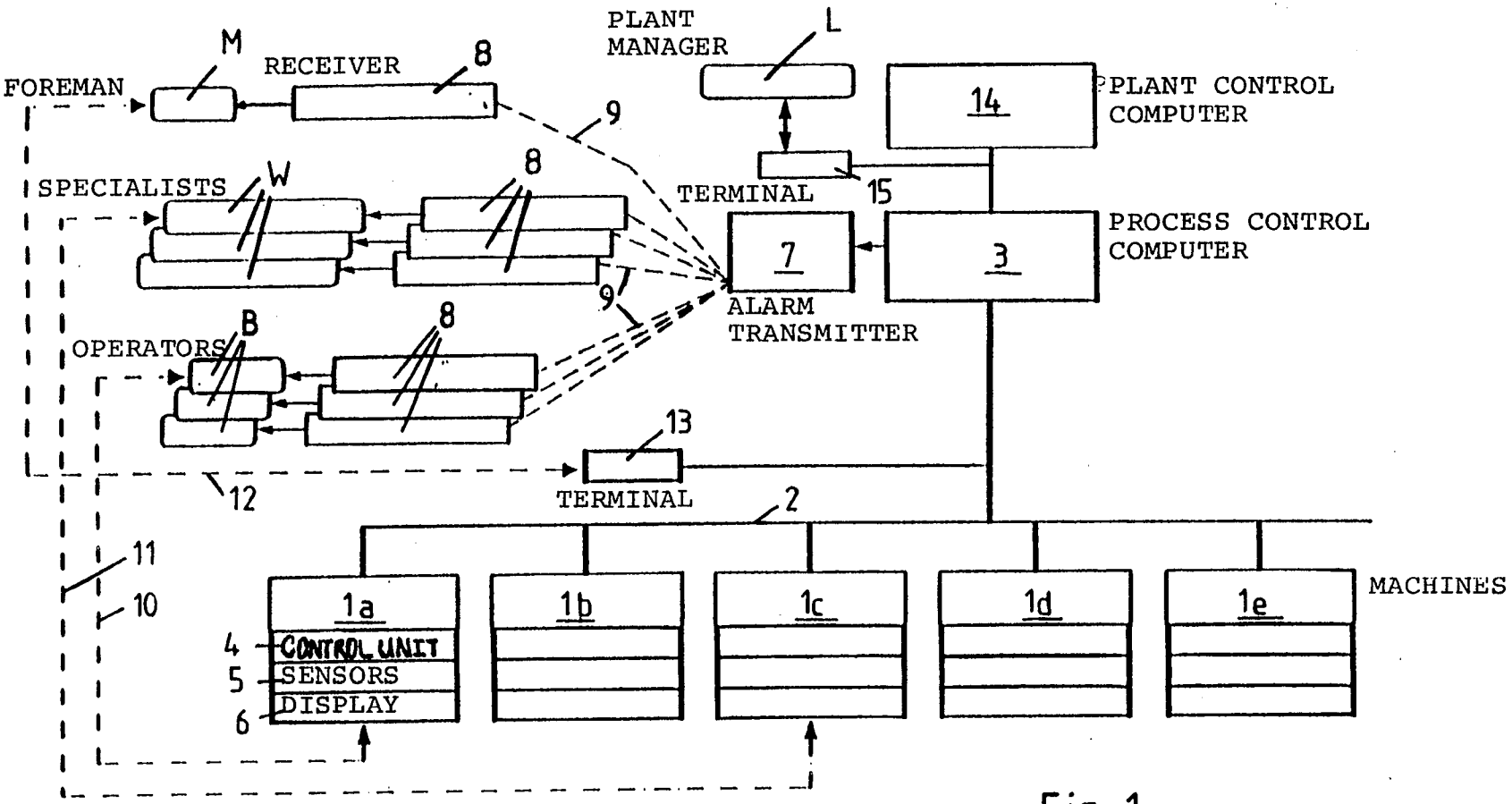
FIG. 1 shows a block diagram display of components of the alarm system in accordance with the invention and the connection of said components.

Reference will now be made in detail to the presently preferred embodiments of the invention, one or more examples of which are illustrated in the accompanying drawings. Each example is provided by way of explanation of the invention, not limitation of the invention. The numbering of components in the drawings is consistent throughout the application, with the same components having the same number in each of the drawings.

In the embodiment of the invention in accordance with FIG. 1, the five machines or conveying systems 1*a*–1*e* are connected ro a process control computer 3 via a communications network 2. Every machine 1 comprises a machine control unit 4, various sensors 5, in particular for detecting malfunctions, and a display plus keyboard 6.

In the event of a malfunction, the respective machine issues a signal via network 2 to the control computer 3. Generally, the issuance of the signal takes place through machine control unit 4, whereby the signal contains details on the type of the malfunction, the urgency for eliminating said malfunction, and the group of personnel required (operator, technician, foreman).

The process control computer receives the malfunction signals, evaluates the individual malfunctions itself and inserts them into a priority queue. In addition, the process control computer also stores the status of the individual machine 1*a*–1*e* in a log file.

Besides this central evaluation of malfunction signals, the process control computer 3 preferably carries out the central monitoring of the individual groups of personnel. For this purpose it is necessary to know the availability of every single person and the tasks he can perform and to save all tasks in a log file.

Figure 3:
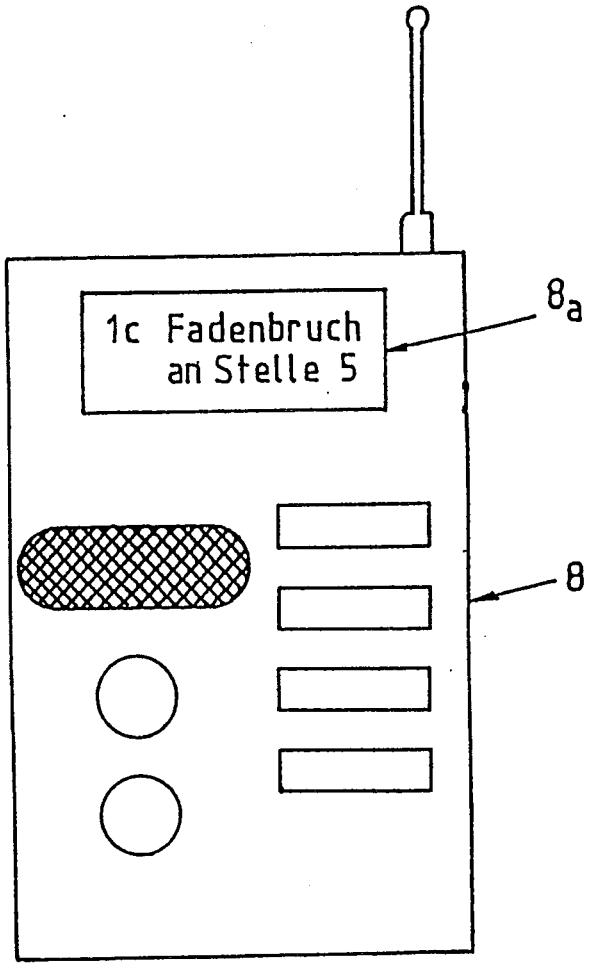
FIG. 3 shows a perspective view of a receiver according to the invention.

An alarm transmitter 7 can be controlled by the process control computer 3. This alarm transmitter comprises a selective call function for individual receivers, in particular for pocket receivers that are characterized by the reference sign 8 and displayed by way of example in FIG. 3. The respective radio links are outlined in broken lines.

Via these receivers 8, which usually are pocket receivers and which emit a sound signal or comprise a short message display 8*a* (FIG. 3) the foreman M, a maintenance specialist W, or an operator B is informed. The person thus alarmed can now proceed to the respective machine 1*a*–1*e* where the display means 6 will provide comprehensive information on the place, type, and urgency of the malfunction. These ways covered by the operator and the maintenance specialists are outlined in broken lines and marked by reference signs 10 and 11. A terminal 13 should be provided to the foreman on the way 12, from which he can either obtain or enter new information. This terminal is usually located at his work place.

In addition, the process control computer 3 is linked to the plant control computer 14, whereby the information transmitted by the process control computer to the plant control computer 14 may be retrieved by the plant manager from terminal 15.

Figure 2:
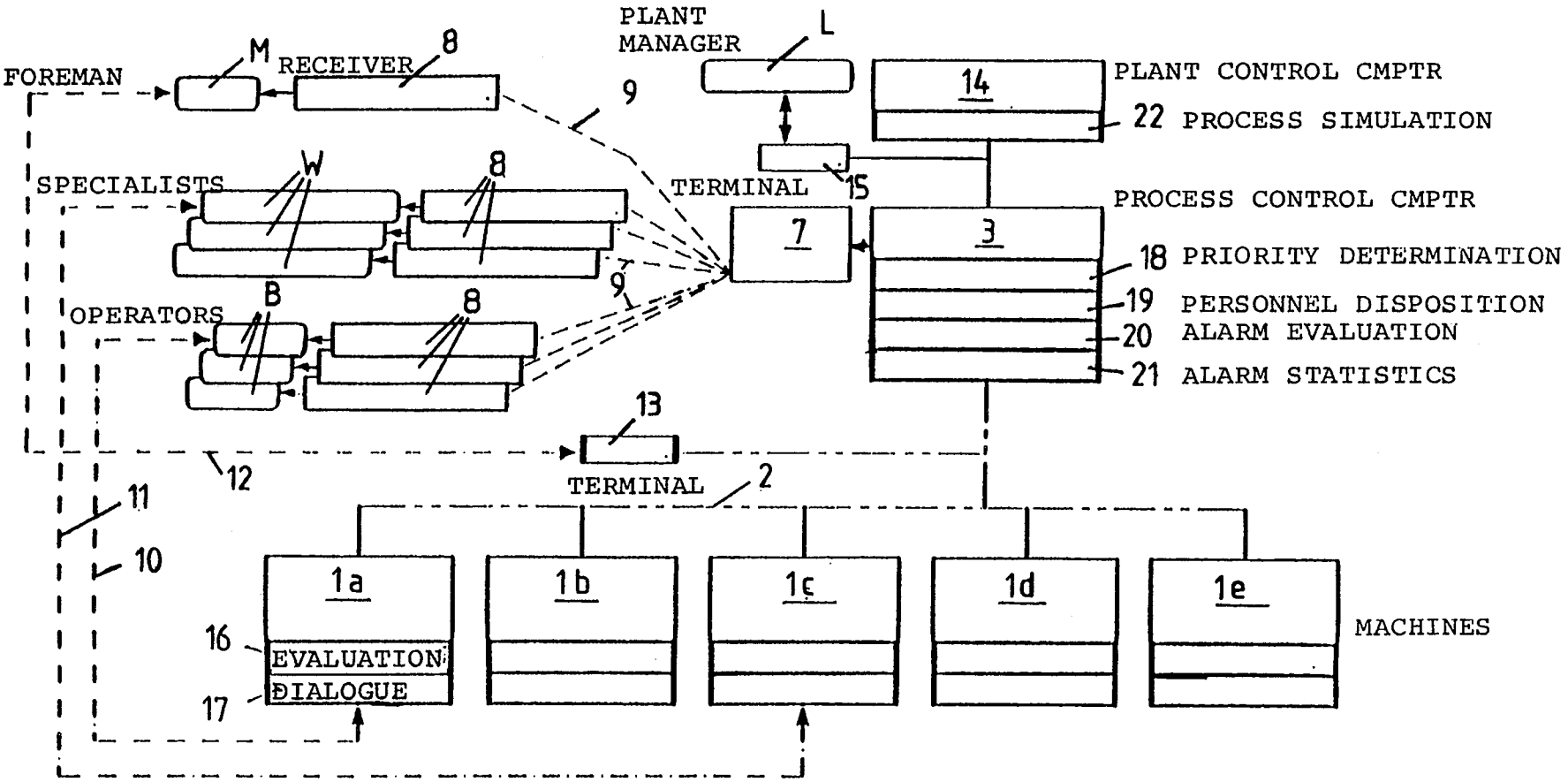
FIG. 2 shows a block diagram display of software modules of the alarm system in accordance with FIG. 1.

The present combination of components in accordance with FIG. 1 more or less uses devices that are required in any case for controlling the production process. The only essential additional parts required are the alarm call device and the programs for the additional functions of the process control computer or the machine. These additional programs are schematically shown in FIG. 2. Additional programs in the machine 1*a*–1*e* are the alarm evaluation 16 and an alarm dialogue 17.

The process control computer 3 is provided with the following programs: priority determination 18, disposition of personnel 19, alarm evaluation 20 (similar to alarm evaluation 16) and the alarm statistics 21.

In the present embodiment the plant control computer 14 is also provided with a process simulation 22. This program will give a preview of the consequences on the process stages and the production caused by the malfunctions that have occurred. This preview has an influence on the priority rating of the individual interventions 18. It is accessible to the foreman M via the dialogue 17.

The alarm system in accordance with the invention works as follows:

A malfunction is recognized in machine 1 or the conveying system. A classification of the malfunction according to type and urgency of the intervention takes place in the machine. A classification is provided below by way of example. The following malfunctions may be established:

a) the machine is out of order due to a malfunction;
b) the machine is only partly in working order due to a malfunction;
c) machine due to lap;
d) machine with high rate of fibre breakage due to soiling;
e) lubrication period exceeded.

The classification by the machine control unit 4 results in the following:

ad a) intervention by a maintenance specialist is required immediately;
ad b) intervention by a maintenance specialist is recommended;
ad c) check by the operator is required immediately;
ad d) check by the operator is recommended;
ad e) check or maintenance work not urgently required.

In accordance with this classification the control unit transmits the following signals to the process control computer 3, whereby the abbreviations have the following meanings:

B=operator
W=maintenance specialist
H=high priority
M=medium priority
T=low priority
ad a) W/H
ad b) W/M
ad c) B/H
ad d) B/M
ad e) W,B/T The process control computer 3, which receives the respective signals from a plurality of machines 1, classifies said signals and sorts them according to their priority. Then it emits pertinent signals to the alarm transmitter 7 through whose radio call the respective maintenance specialists or operators may be reached. This person then proceeds to the designated machine that displays the place of the malfunction and the expected intervention. Thereafter the person acknowledges the alarm, eliminates the malfunction and then reports the success or the result of the work.

The main task of the plant manager L is the disposition of personnel and the adjustment of process parameters. The latter applies primarily to the alteration of priorities.

The importance of process control computers for future spinning mills provided with a limited number of personnel can hardly be overestimated. Whereas in the past whole teams were available for the various operating and maintenance works, only individual persons will be available in the future for keeping the spinning mill in operation. By reference to FIG. 4, the meaning of this change will be explained in closer detail. According to this, a possible organization diagram for establishing a process control system is at first outlined in the following figures. Subsequently, details of the communication links within such a system are explained. In this respect, operator support will be outlined. This support is of the utmost importance not only for eliminating malfunctions, but also for ensuring the proper operation of the spinning mill as such (over the whole operating period).

Figure 4:
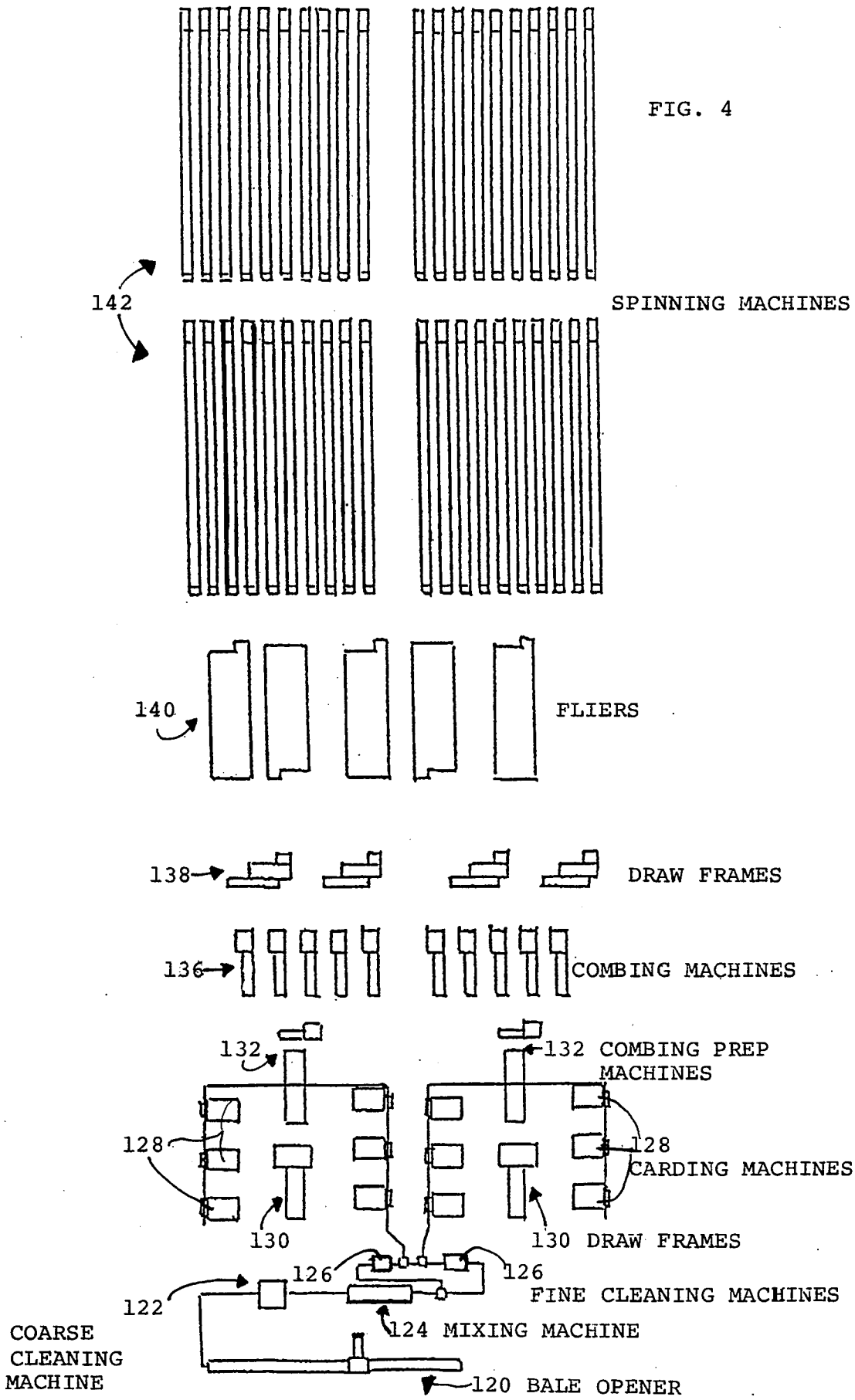
FIG. 4 shows a schematical display of a spinning mill for manufacturing combed yarn made from cotton or a cotton/chemical fibre mixture.

The exemplary spinning mill shown in FIG. 4 may comprise a bale opener 120, a coarse cleaning machine 122, a mixing machine 124, two fine cleaning machines 126, twelve carding machines 128, two drawing frames 130 (first drawing passage), two combing preparation machines 132, ten combing machines 136, four drawing frames 138 (second drawing passage), five fliers 140 and forty ring spinning machines 142. This is a present conventional arrangement for manufacturing so-called ring-spun yarn. The ring spinning process can be replaced by a more modern spinning process (e.g. rotor spinning), whereby the fliers can then be dropped. As, however, the principles of this invention may be applied independent of the type of the final spinning stage, the explanation in connection with conventional ring spinning machines also pertains to the use of the invention with new spinning methods. The winding department is not shown in FIG. 4, because it is not used in new spinning methods (e.g. rotor spinning).

Figure 5:
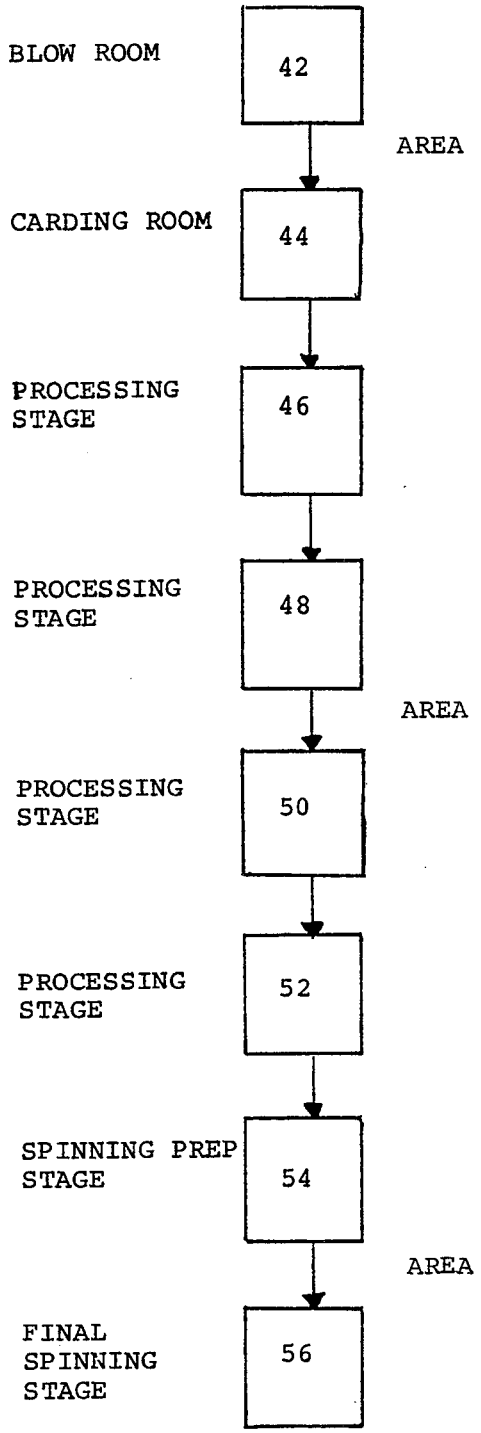
FIG. 5 shows a schematical distribution of the spinning mill of FIG. 4 in processing stages.

The spinning mill in accordance with FIG. 4 is again shown schematically in FIG. 5, whereby in the latter case the machines are grouped into "processing stages". In accordance with this approach, the bale opener 120, the coarse cleaning machine 122, the mixing machine 124 and the fine cleaning machine 126 form a so-called blow room 42 that supplies the carding room 44 with more of less fully opened and cleaned fibrous material. Within the blow room the fibrous material is conveyed from machine to machine by means of a pneumatic conveying system (stream of air), whereby the system ends in the carding room. The carding machines 128 each supply, as an intermediate product, a sliver that is placed in a suitable container (a so-called "can) that has to be further conveyed.

The first drawing passage (through the drawing frames 130) and the second drawing passage (through the drawing frames 136) each form a processing stage 46 or 52, respectively. In between, the combing preparation machines 132 form the processing stage 48 and the combing machines 134 a processing stage 50. Finally, the fliers 138 form a spinning preparation stage 54 and the ring spinning machines 140 a final spinning stage 56.

The final results of the schematically displayed spinning process are influenced by a large number of factors, which are not discussed herein in detail. One important factor is the raw material to be processed, which can be displayed as a group of fibre qualities that can be ascertained individually (e.g. fibre fineness, fibre type, fibre hardness). When processing natural fibres (in particular cotton fibres) it is not possible to "order" raw material with a predetermined staple diagram. Quite the contrary, one has to produce the desired diagram by suitable processing of fibres from various origins. There are three processing stages that particularly influence the staple diagram of the material to be spun, i.e.:

the blow room,
the carding room,
the combing room.

Monitoring the flow of material plays an essential role for the spinning mill. FIG. 4 shows the complexity of this task. One ought to bear in mind the number of possible "paths" between the bale storehouse (for raw cotton) and the final spinning stage. This problems was solved in the past by the plant manager and his workers.

Figure 6:
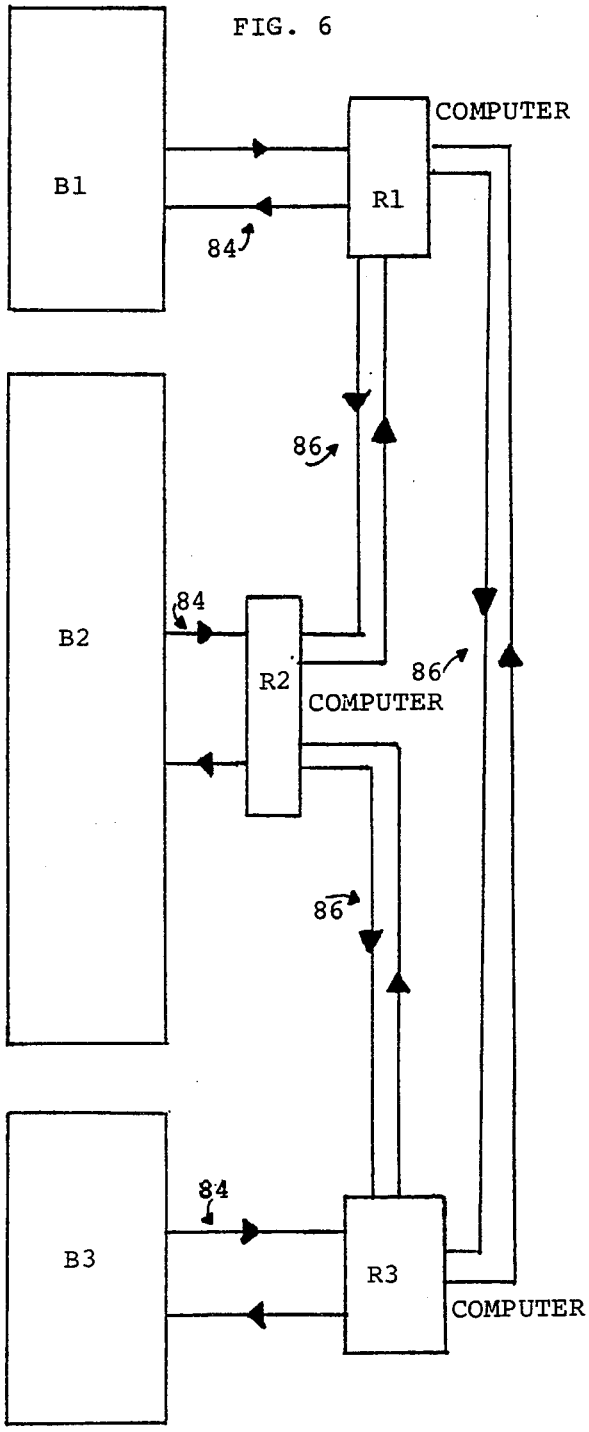
FIG. 6 shows a possible allocation of such processing stages depicted in FIG. 5 to "areas", each with its own process control computer.

In our German patent application No. 39 24 779 of Jun. 26, 1989 we describe a process control system according to which the spinning mill is organized in "areas" and where signals from one area may be used for controlling preceding areas. One example for such a plant is schematically shown in FIG. 6, whereby the plant comprises three areas B1, B2 and B3. Each area is allocated to its own process control computer R1, R2, R3. Each computer R1, R2, R3 is linked up with one another for exchanging signals (schematically outlined in FIG. 6 by links 86). One skilled in the art will quickly realize that the display in FIG. 6 is purely schematical. Naturally, it is possible to provide only a single process control computer connected to all areas of the spinning plant for performing the desired exchange of signals between these areas. The arrangement shown with one process control computer R per area B, however, is sensible and will be used for the following explanation.

Area B1 comprises the blow room 42 and the carding room 44 (FIG. 5) .

Area B2 comprises both the two drafting passages 46, 52 (FIG. 5) and the combing preparation stage 48 and the combing room 50.

The area B3 comprises the flyer 54 and the final spinning stage 56 (FIG. 5), possibly also a winding department.

A spinning mill with a limited number of workers can naturally also be achieved by automating functions formerly carried out by the staff. These functions in particular comprise the transport of the material between the processing stages and the insertion of the material in the machine used for the further processing of said material. In addition, the personnel is responsible for supervising the plant and eliminating malfunctions. The part of this task that is taken over by automation and the control system is outlined below in closer detail by reference to FIG. 7. Area 3 (FIG. 6) shall serve here as an example.

Figure 7:
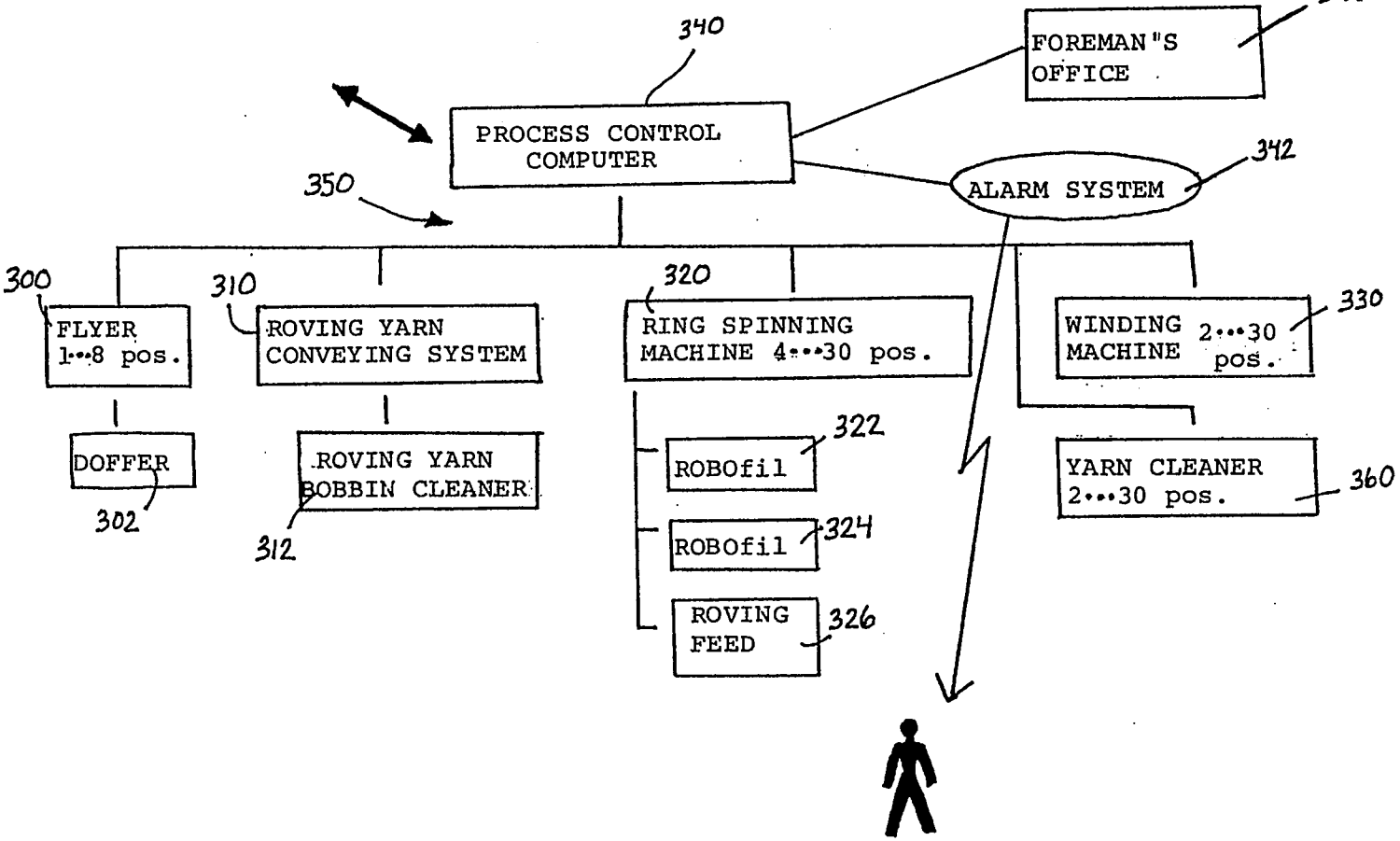
FIG. 7 shows an "area" in accordance with FIG. 6, whereby further details of the communications links within the area are explained, and FIG. 8 provides further details of a system in accordance with FIG. 7.

A practical embodiment of area B3 for an automated plant is shown in FIG. 7, but only schematically in order to outline the computerized side of the system. The shown part of the plant comprises (according to the sequence of the processing stages, i.e. the "concatenation" of the machines):

a) the flyer stage 300;
b) a final spinning stage 320, formed in this example by ring spinning machines;
c) a roving yarn conveying system 310 for carrying speed frame bobbins from the flyer stage 300 to the final spinning stage 320 and empty bobbins back from the final spinnings stage 320 back to the flyer stage 300; and
d) a rewinding stage 330 to transform the cops formed on the ring spinning machine to larger (cylindrical or conical) packages.

Each processing stage 300, 320, 330 comprises a plurality of main work units (machines) that are each provided with a control unit. Said control units are not shown in FIG. 7, but are explained below. Robot controlled units (automatic operating devices) directly allocated to these machines are connected to the respective machine control units. In FIG. 7 a doffer is provided for each flyer of stage 300; the function "flyer doffing" is indicated in FIG. 7 by box 302. A possible embodiment is shown, for example, in EP 360 149 or DE-OS 3 702 265.

In FIG. 7 one automatic operating device per row of spinning places for operating said spinning place and a creeling operating device for the supply of roving yarn are provided for each ring spinning machine of stage 320. The function of "operating the spinning place" is indicated by box 322, 324 (one box per row of spinning places) and that of "supply of roving yarn" by box 326. A possible embodiment is shown, for example, in EP 394 708 and 392 482.

The roving yarn conveying system 310 is also provided with its own control unit, which will not be explained in closer detail. The system 310 comprises a unit for cleaning roving bobbins before they are given back to the flyer stage 300. In FIG. 7 the function "roving bobbin cleaner" is indicated by box 312. A possible embodiment of this part of the plant is partly shown in EP 392 482.

The ring spinning machines of stage 320 and the winding machines of stage 330 together .form an "interlinked group of machines", thus ensuring the transport of the cops to the winding machines. This interlinked group of machines is controlled by the winding machines.

A network 350 is provided for connecting all machines of stages 300, 320, 330 and the system 310 for the exchange of signals (data transfer) with a process control computer 340. Computer 340 directly operates an alarm system 342 and a terminal 344 at the control station or the foreman's office.

A very important function concerning the rewinding of ring spinning yarn is the so-called yarn cleaning, indicated by box 360. The yarn cleaner is connected to the process control computer 340 via the network 350. This device ensures that defects in the yarn are eliminated and, simultaneously, information (data) is collected that allows deductions on the preceding processing stages. The yarn cleaning function is carried out by the winding machine.

Each machine is also provided with a so-called "user interface" that is connected to the respective control unit and that allows man-machine (or even robot-machine) communication. The "user interface" may also be termed an "operator console". An example of such a user interface is shown in the DE-OS 37 34 277. It does not apply to a ring spinning machine, but to a drafting frame. The principle is the same for all such operating means.

In accordance with a second aspect of the invention, the plat is programmed and designed in such a way that the control computer 340 can provide operator support via the user interface of the respective machine, i.e. the control computer can send control commands via the network 350 and the machine control units can receive and act upon such control commands, so that the condition of the user interface is determined by the control computer 340 via the respective control units.

Naturally, the machine can be provided with more than a "user interface". The important aspect is, however, that the user interface (or each user interface) is connected to the machine control unit, so that signals can be exchanged between the user interface and the machine control unit. If an auxiliary device is provided, for example, with a user interface in a machine and said device is subordinate to the machine control unit, the user interface of said device has to be allocated to the machine.

Figure 8:
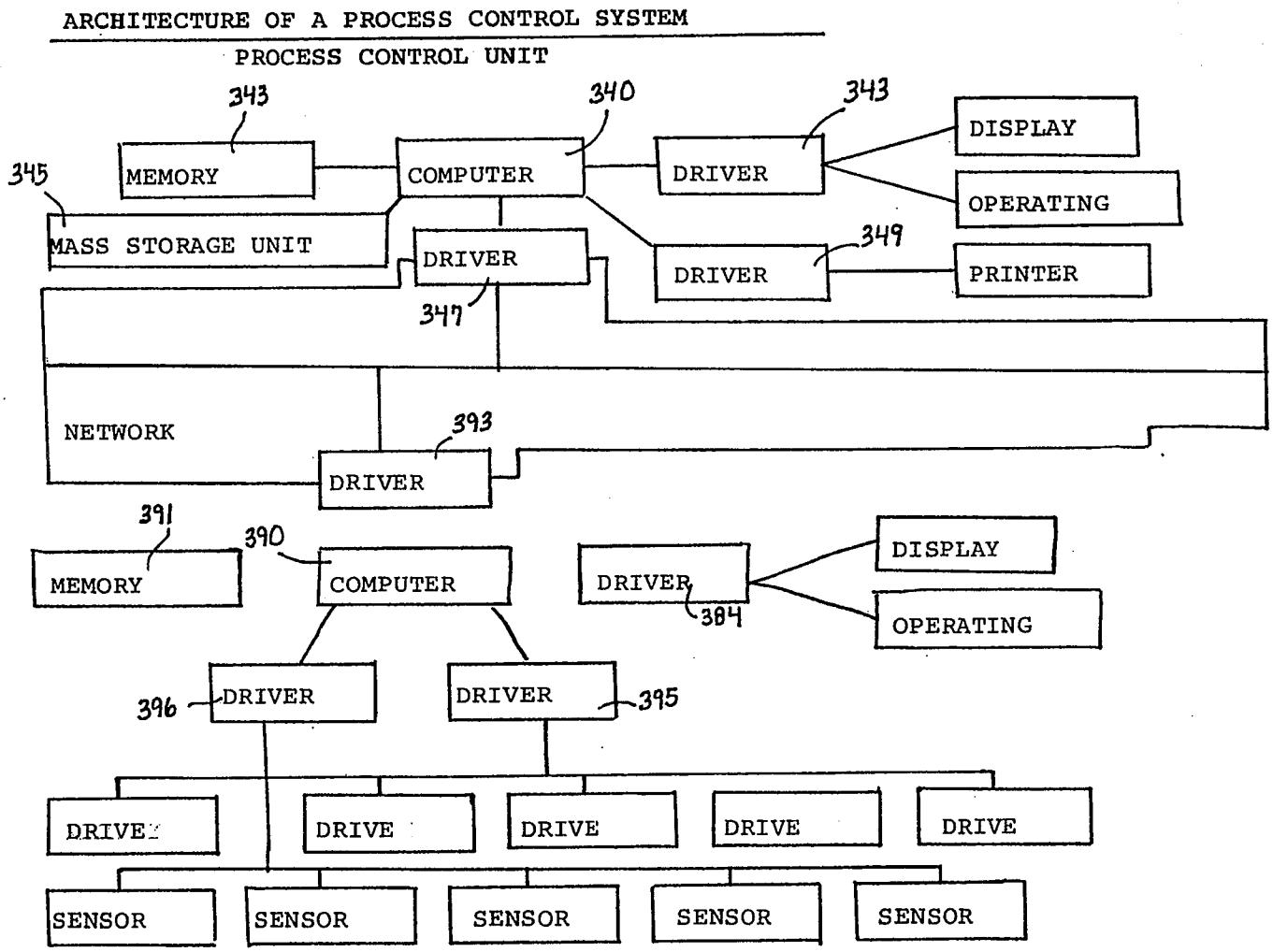

FIG. 8 shows a possible variation in the architecture of process controls in accordance with FIG. 7. FIG. 8 again shows the control computer 340 and the network 350 together with a computer 390 of a machine control unit of the plant (e.g. the roving yarn conveying system 310 that can be regarded as equivalent for the purpose of explaining the computer side of a "machine"). Each computer 340, 390 comprises memory 343, 345 or 391 allocated to it and drivers 347, 349 or 393, 394, 395, 396.

Drivers 349 or 394 determine the necessary interfaces for the communication of the computers 340, 390 with their user interfaces, indicated here as display, operation and printer. Driver 347 determines the interface between the control computer 340 and the network 350, and driver 393 determines the interface between the network 350 and the machine control unit 390.

Driver 395 determines the interfaces between the machine control unit 390 and the drive controlled by it (actuator). Driver 396 determines the interface between the machine control unit 390 and the sensors allocated to it.

Important actuator elements in a spinning machine are those that serve for "stopping" a spinning place, whereby "stopping" is to be understood as "stopping an effectively producing spinning place". In most cases not all working elements of this spinning place are stopped when an individual spinning place is brought to a standstill, but the spinning there is interrupted. This can take place, for example, by interrupting the supply of material and/or by bringing about a sliver breakage.

In a more or less automated machine (e.g. the rotor spinning machine) this can easily be carried out by a central machine control unit in either the one way or the other. For example, the drive to the feed roller can be interrupted in order to interrupt the supply of material to the opening cylinder or the rotor of the spinning place. A so-called quality cut within the quality control can also be carried out to interrupt the course of the thread.

In present conventional ring spinning machines such options are no longer available, because the actuator units of the individual spinning places are no longer under the direct control of the central machine control unit. In such machines, however, the stopping of a spinning place can be effected by activating a slubbing clip to interrupt the supply of material. A slubbing clip that suits this purpose has been shown in FIGS. 15 to 19 of the EP 388 938. A slubbing clip is often called a roving stop or clamp.

The use of a slubbing clip for interrupting the supply of material is important in all types of machines that supply the material to be fed via a drafting frame to the spinning elements, because it is usually impossible to turn off one single position of a drafting frame. The slubbing clips of the individual spinning places can naturally each be provided with one activating means. They may then also be activated from a central machine control unit. Examples of such slubbing clips are to be found in EP 322 636 and EP 353 575.

In a preferred embodiment the invention is realized in a plant in accordance with FIGS. 7 and 8, i.e. a plant in which at least one machine control unit comprises a user interface, and in which the process control computer can use said user interface for communicating with a man at this machine. By this arrangement it is relatively easily safeguarded that in the whole plant controlled by the computer a certain signal is provided with a specific meaning. This arrangement can be compared with another system in which the operator support takes place via a system that is independent of the machine control units, e.g. in accordance with the U.S. Pat. No. 4,194,349. The advantages of the combination according to this invention are particularly striking in the event that a process control computer influences both the operator support as well as the control of the machines, e.g. in a doffer management system for ring spinning machines, similar to a system in accordance with U.S. Pat. No. 4,665,686.

The operator support provided by the user interface on the respective machine clearly ensures that help is offered wherever it is required. This also allows facilitating the alarm/call system, because in principle the operator only has be guided to the affected machine without providing beforehand the precise information on the action to be taken. The alarm/call system must clearly ensure that the operator is informed on the urgency or priority of the call for hte operator or that the correct help is provided or person called to the affected machine (doffer help, maintenance, elimination of sliver breakage).

Through the user interface an instruction can be passed on to the operator, so that he carries out an action that cannot be performed by the machine control unit itself, e.g. because the required actuating means is not included in the respective machine or because the machine is not controlled by the machine control unit. One example for such an action would be the stopping of a badly functioning spinning place where the machine cannot intervene directly in said spinning place. The operator is preferably in the position (or is even "forced") to bring about the generation of a signal that represents the execution of an instruction, and informs the machine control unit or the process control computer thereof.

From the above explanations the increasing importance of malfunctions in the whole spinning mill become more evident. This importance comprises the following aspects.

- in an automated spinning mill there are far more devices susceptible to malfunctions;
- these devices are more complex than previous basic machines, whereby the new machines have to become more complex in order to cooperate with the new devices;
- the number of people who are able to eliminate the malfunctions and their effects is reduced.
- as, however, the spinning mill cannot yet be operated "fully automated", personnel are still required for day-to-day operations; a "malfunction" can accordingly be regarded as a situation in which the performance of the normal works is encumbered by temporarily overstressing the personnel that are present (even if the machines and their auxiliary devices do not comprise any defects).

The supervision of the plant by suitable sensors that are connected to the process control computer therefore form an important feature of future spinning mills. In this respect said computer must provide the following support for the remaining personnel:

- the tasks necessary to guarantee the proper operation should be indicated to the personnel;
- malfunctions that could lead to damage in the machine (e.g. a lap on the sliver calendar of the drafting frame of a ring spinning machine) should be recognized, and the personnel should be informed thereof as quickly as possible;
- "accumulations" of malfunctions and essentially normal handling tasks must be avoided because they can lead to excessive stress that cannot be coped with and that therefore might lead to "crashes".

All this requires collecting and evaluating large amounts of information. This task is assumed by the process control computer (in cooperation with the sensing means and the information transmission system). This provides an essential improvement in both the efficiency of the plant and the quality of its product. Ring spinning machines may also be operated, for example, in accordance with a method of our German patent application No. 39 28 755.6 of Aug. 30, 1989. This means, however, that the plant works more closely at its "limit", thus considerably increasing the risks of deviating from the "normal" operation.

The operator support therefore preferably comprises the following aspects:

1) The most suitable person in the plant shall be notified at a suitable time of the necessity of a certain task to be undertaken (this can either be the elimination of a malfunction or the initiation of a normal process).
2) In at least some cases said person shall receive near or at the place of his task additional information on the required task (e.g. localization of a defect within a machine or a group of components, or details concerning the necessary alterations to the machine in the event of a change in the batch).

The process control computer, however, requires information from a person concerning the success or failure of his work, in particular when this success or failure has an effect on the efficiency of the plant.

In a preferred arrangement in accordance with this invention, the overall problem is solved as follows:

- the personnel are relieved from supervising the plant by the process control computer;
- via a call transmitter/receiver system, personnel can selectively be notified of a necessary task, whereby only a minimal amount of information needs to be forwarded over the call system;
- the additional information is available (if required) on the user interface of the affected machine or auxiliary device;
- acknowledge messages from man to the machine are preferably transmitted by the machine itself e.g. the user interface comprises signal generation means for transmitting a suitable response via the network to the computer.

An alternative solution according to DE-OS 40 31 419 is also possible. In accordance with this solution, acknowledge messages are transmitted via a transmitter to a central unit. This, however, requires a relatively complex entry of data by a worker, which might easily lead to errors and wrong conclusions in the central unit. With the present system, the operating instructions on the machine's user interface may demand, for example, a simple entry via a keyboard provided with the user interface for displaying the success or failure. According to this patter, it is even possible to arrange a simple dialogue between man and the process control computer.

The same effect can naturally be achieved in that the "operating stations" are placed next to the machines and connected to the process control computer via a suitable network. This, however, requires doubling the user interfaces, as modern machines have to be equipped with such interfaces in any case. There is the additional risk of mix-ups or ambiguity in the instructions, possibly leading to catastrophic consequences in the operation of the plant.

A further option consists of the call system only indicating to the receiver that his intervention is required (e.g. by a "beep"). The required information on the place of work is given separately via the telephone line or a central display. The detailed operating support (with details on the task) is, however, preferably supplied on site. This option therefore requires a "distribution" of the system:

Call (catch the attention).

Impart urgency.

Disclose task.

Provide detailed support.

Preferably, the call, urgency and the disclosure of the place of the task is combined in one receiver.

A process control computer (with or without a plant control computer) is also in the position (if programmed respectively), to provide further support, i.e. by simulating the task to be performed through a forthcoming work period. For this purpose, the controlled plant (or the controlled part thereof) is "copied" by equations. These equations represent the connections between the essential performance data of the plant (or the part thereof). Based on certain assumptions, "scenarios" can be calculated by the program, whereby "optimum" and "difficult" scenarios can be provided for the task to be undertaken. The operator support can then be adjusted to follow the best possible scenarios or to avoid the worst possible ones.

The work period to be simulated depends on a number of factors. In any case, one must consider the computer computing capacity. The simulation must not use up so much processing capacity that the other tasks of the process control computer are delayed. Therefore it might be sensible to pass on this task to a plant control computer, if there is such a computer and it has some free capacity left. If there is sufficient capacity available in the process control computer, the simulation can also be performed at the "process control level".

The type of the plant also has an influence. The "simulated work period" should comprise more than a single operating shift, so that the "second" or next shift not only has to solve the problems of the "optimized" shift. Where a spinning mill is adjusted to "flexible manufacturing" (with frequent changes in batches and assortments), it does not make sense to simulate many operating shifts, as the whole organization has to adapt to short-term adjustments and a quickly changing situation. Where there are relatively stable production conditions over longer periods, it is worth simulating longer periods and to select "on a long-term basis" optimal scenarios.

Because a malfunction signal is sent from the machine control unit to the process control computer, it is possible to have the machine provide at least a part of the user support on its own user interface, e.g. the precise place of the malfunction, possible also the time at which the malfunction occurred. This has the advantage that at least a part of the support is independent of the process control computer and that it can still be provided even if said computer has broken down.

Applications serving as examples

1. Priority of the Alarm

The user is normally not able to correctly assess the priority in repairing the malfunction.

In order to do so, he would have to know the momentary overall condition of the system. The consequences of a malfunction not only depend on a defective partial function (e.g. lap in a spinning place), but also on the duration of the malfunction, the parts of the system also affected by this malfunction in form of a linked flow of materials and the environment around the process. Thus it does not make sense to eliminate a fibre breakage if there is a final doffer process directly before switching to another assortment.

Conclusion: The alarm system must continuously evaluate the priorities in the elimination of malfunctions due to the prevailing condition of the plant and inform the operator thereof.

This takes place by the computer as follows:

The computer accepts the messages on the operating condition of the individual machines. This is a general function of any process control system. Example: The computer receives from a ring spinning machine the number of nonproductive spindles.

In the computer certain threshold values are determined in accordance with the prevailing operating condition. Upon exceeding these thresholds, an alarm is generated. Example: A ring spinning machine is in the current operating condition "start after doffing". The limit for nonproductive spindles is set at ten percent. This limit is established by the lifting capacity of the operating computer (see also DE-OS 39 28 755).

The alarm thus generated is assessed by the computer by way of a priority list.

In the uppermost stage of the hierarchy the priority is clearly fixed:

1—Danger for persons (e.g. fire)

2—Danger for the equipment (e.g. lack of lubricant)

3—Faulty production (e.g. wrong yarn number)

4—Interruption of the production (e.g. too many sliver breakages)

5—Intervals for preventive service (e.g. exchange of whirls is necessary)

In the second stage of the hierarchy the priority is established by way of set rules. The assessed consequential costs (see above) govern the priority classes 3–5. These are calculated by the computer in a simulation based on the present operating condition of the plant. Example: the computer has generated the alarms "machine 3=number of sliver breakages too high" and "machine 7=stoppage during the doffing". It compares the presumable costs of both cases by way of an extrapolation and comes to the conclusion that the elimination of the malfunction in machine 7 has the higher priority.

The computer keeps track of the work schedule of the individual operators. It compares the priority of the current task with the priority list and generates an alarm call to the operator with a task of a lower priority as soon as an alarm of a higher priority occurs.

When distributing tasks the computer takes the abilities of the individual operator into account in that it only considers persons for certain malfunctions that are able to eliminate them. Example (continuation of the case above): The work schedule shows for operator "A" the exchange of roving yarn in machine 2, for operator "B" the cleaning of upper rollers in machine 5. The computer now alarms operator "B" for the task of "eliminating the malfunction in machine 7", the latter task having the higher priority. If operator "B" is only qualified for cleaning works, the alarm goes to operator "A".

The work schedule of the operator team is shown in the display of the process control system and may be adjusted by the supervisor (foreman, plant manager). Example (continuation of the case above): The foreman wishes that the work of operator "B" is continued and passes the elimination of the malfunction to operator "A". He directly imparts a higher qualification to this operator. The alarm now goes to operator "A".

A particular advantage of this method consists of the fact that no difference is made between service works and the elimination of the malfunctions. The limits in day-to-day operations are very narrow between these. In a plant with a limited number of personnel it is essential to get in control of planned maintenance work and unplanned eliminations of malfunctions. Systems that concentrate only on the one or the other task will encounter problems in day-to-day operations.

2. Acknowledgement of the Alarm and the Task

The generally known method consists of a user confirming the alarm. The malfunction continues to exist until it is eliminated, while the alarm is "silenced" and limited to a malfunction indication. This indication will disappear as soon as the malfunction is removed.

This operating philosophy has proved its efficiency in simple systems. However, it is not sufficient for spinning mills with a limited number of personnel. In the event of a sequence of tasks to be performed it leads to the fact that the user acknowledges each new alarm by reflex. The correct priority in the elimination of the malfunctions is neither supported nor supervised. In a system with several operators it will fail to work because the competence for acknowledging and eliminating the malfunction remains unclear.

Conclusion: In a larger production plant with several operators the alarm call must be directed to the person and be upheld until the person concerned has concluded his task on the site of the malfunction. The allocation of the task takes place by way of the permanent display. Any change in this display is acknowledged by a separate signal, the recognition of which has to be confirmed.

This occurs for the computer and the recipient as follows:

The computer has found a new task for the operator. It transmits this task via a call transmitter to the receiver of this specific operator.

The receiver alarms the operator by a conspicuous signal and, simultaneously, displays the new site and task (catch word).

The operator acknowledges recognition of the new task on the receiver.

The operator concludes his present task and proceeds to the new site and gains the details of his new task from the user interface on the respective machine.

The operator carries out the task. If the control unit of the machine recognizes the repair, the defective condition will disappear and the instructions for the next task will automatically be displayed. If the respective control unit cannot recognize the elimination of the malfunction through its sensing means, the operator confirms the termination of the work via the local user interface.

If the operator does not react in time, i.e. he does not show up at the site of the malfunction or does not carry out the task, an alarm of a higher priority is emitted and the respective operator is recognized as "not being able to react". This takes place in accordance with the simple principle of time supervision. The computer evaluates the situation accordingly, and makes use of a new operator with the new alarm.

The particular advantage of this system consists of the fact that each alarm is treated as a single, personal order whose performance is supervised. In the event of difficulties or the failure of an operator to turn up, the process control system automatically reacts correctly.

3. Call for Help or Alarm Raised by the Operator

The operator who cannot cope with a task only has the option in a conventional alarm system to refer to the foreman's office for further help. For this he has to leave his current place of work.

Conclusion: An alarm system must take into account that the operator, too, is also a "sensing means" in the plant and is able to convey his conclusions in a simple manner to the process control system without having to leave his place of work.

The integration of the machine control unit into the alarm system and the use of networks and a process control computer now provide a far better solution:

The user enters his conclusions/call for help/alarm on site via the user interface on the machine.

This alarm is further treated like any other alarm raised by the machine control unit and automatically leads to calling up further operators with altered priorities.

4. Communications between Foreman—Operator

The operator's superior should not only know the work schedule, but should also stay in touch with the individual operators. One essential element is the protection of the personnel: in the extreme case of a fire he must advise all people to leave the plant or call them up for duty in the plant fire brigade. It is also possible that he wants to gather a larger number of operators for an important job to be carried out jointly. The signals conveyed by common call receivers are usually not sufficient for such a broad selection of such differentiated alarms. Receivers with a larger display obstruct the carrier and are regarded as bothersome by these.

Conclusion: The alarm system should support the transmission of messages to the individual operator or user without them having to leave their place of work. The receivers should make do without large text displays to prevent them from obstructing the user by their size and weight.

The integration of the machine control unit into the alarm system and the use of networks and a process control computer now allow a more inexpensive solution:

In his office the foreman enters his message into the user interface of the process control computer.

The process control computer ascertains the machines on which every operator is working by the alarm list provided.

Through a normal alarm (the urgency of which is determined in accordance with the entry made by the foreman) the user is called to the user interface of the machine operated by him.

5. Work Psychological Stress by Multiple Alarms

It could be considered that by a collective alarm each operator is called to the next user interface on the machine for orientation purposes, and to continue the communication there more directly. Such a collective alarm system would be far simpler than a call system. It could, for example, consist of a loud wail of a siren or a sequence of bright flashes of light. However, this contradicts the findings of work psychologist that the human being desires a constant environment and a steady work routine.

For the same reason, alarm systems without a differentiated evaluation of the individual alarms are unfavorable from a work psychological point of view. Presently, common alarm systems with a central unit and call receivers do not take this demand into account.

Conclusion: the system must take the operator's desire for a steady work routine into account.

This is made by suitably programming the process control computer:

The individual tasks are taken into account with a minimum time required for carrying it out under normal conditions. During this time competing alarms with the same priority are suppressed totally.

The number of alarms per shift is evaluated by the computer and calculated in a "stress factor" in accordance with the special qualifications of the individual operator. When allocating further tasks, the computer takes into account this stress factor in accordance with the respective qualification of the operator.

The exemplary applications 1 to 5 are possible either individually or in combinations. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the claims and their equivalents.

We claim:

1. An alarm system for eliminating malfunctions in textile machines, comprising:

a control unit configured with each said textile machine, said control unit comprising evaluating means for continuously classifying types of malfunctions occurring at said textile machine, assigning a priority to the malfunctions, designating a specific type of operator necessary to correct the malfunctions, and generating a corresponding malfunction signal containing information on the classification, priority, and type operator related to the malfunctions;

a central process control computer in communication with each said control unit, said process control computer receiving said malfunction signals from all of said textile machines, said central process control computer comprising program means for categorizing, and prioritizing all received said malfunction signals from said control units and selecting particular operators based on priority of malfunctions needed to correct the malfunctions, said central process control computer controlling elimination of the malfunctions by priority;

an alarm call transmitter system operably configured with and controlled by said process control computer, said transmitter system comprising means for individually summoning to the appropriate malfunctioning textile machines one or more specific operators selected by said central process control computer, said summoning means identifying to the operators the respective malfunctions occurring at said textile machines, said transmitter system including receivers carried by the operators for receiving alarm signals from said alarm call transmitter system.

2. The alarm system as in claim 1, wherein said process control computer further includes program means for determining the availability of specific type operators and for selectively alerting specific operators necessary to correct particular type malfunctions at malfunctioning machines according to the priority of the malfunctions.

3. The alarm system as in claim 2, wherein said process control computer further includes program means for coordinating work schedules of a plurality of operators and for ascertaining the availability of a particular operator necessary for correction of any particular malfunction.

4. The alarm system as in claim 1, wherein said process control computer further includes program means for maintaining a log file on each said machine, said log file recording malfunctions occurring at said machines.

5. The alarm system as in claim 1, wherein said receivers include an alphanumeric display for short texts indicating at least site and type of malfunction.

6. The alarm system as in claim 1, wherein said alarm call transmitter system includes display means for providing an operator information related to the malfunction.

7. The alarm system as in claim 6, wherein said display means are located at each said machine.

8. The alarm system as in claim 6, wherein said display means comprise a central display unit common to a plurality of said machines.

9. The alarm system as in claim 1, further comprising an operator interface device operatively disposed relative said machines and configured to communicate with said process control computer.

10. The alarm system as in claim 9, wherein said interface device is configured to communicate with a travelling service unit for the machines.

11. The alarm system as in claim 9, wherein said interface device is centrally located and common to a plurality of said machines.

12. The alarm system as in claim 9, wherein a said interface device is configured with each said machine.

13. The alarm system as in claim 1, further comprising a plant control computer, said process control computer being interfaced with said plant control computer, said plant control computer comprising program means to execute a process simulation for providing a prediction on the consequences of a malfunction on the machine process.

14. The alarm system as in claim 13, wherein said process control computer further comprises program means for incorporating the consequence prediction generated by said plant control computer into the priority ranking of said malfunction signals received from said control units.

15. A process for eliminating malfunctions in a plurality of textile machines, comprising the steps of:

detecting, categorizing, and prioritizing the malfunctions generated at each of the textile machines through a machine control unit associated with each machine;

generating corresponding malfunction signals with each of the machine control units, the malfunction signals containing information on at least the category and priority of malfunctions occurring at the respective machines;

sending the malfunction signals from all of the machine control units to a central process control computer and categorizing and prioritizing the malfunction signals with the process control computer;

with the central process computer, assigning particular operators necessary to correct the prioritized malfunctions from a stored library of information on operators, the central process computer determining from the library the availability of individual type operators;

selectively alerting the operators selected by the central process computer through an alarm call transmitter system associated with the process control computer, the system including individual receivers carried by the receiving a message from the alarm call transmitter system directing the operators to the malfunctioning machine they have been selected to repair and indicating the type of malfunction.

16. The process as in claim 15, further comprising continuously monitoring the availability of specific operators for correcting particular types of malfunctions with the process control computer.

17. The process as in claim 16, further comprising coordinating the work schedules of a plurality of different types of operators so as to aid in determining the availability of any particular operator.

18. The process as in claim 15, further comprising sending the operator an alphanumeric message through the receiver carried by the operator indicating the site of and type of malfunction he is to correct.

19. The process as in claim 15, further comprising providing an operator additional information on the malfunction through a display terminal remote from the process control computer.

20. The process as in claim 15, further comprising providing an interface device between the operator and the process control computer.

21. The process as in claim 15, further comprising predicting the consequences of the malfunctions by a simulation process and using the predicted consequences in assigning priority to the malfunctions by the process control computer.

22. The process as in claim 21, further comprising interfacing the process control computer with a central plant control computer for conducting the simulation.

23. The process as in claim 15, further comprising maintaining a log file on the malfunction status of the textile machines with the process control computer.

* * * * *